US008714612B2

(12) United States Patent
Chinn

(10) Patent No.: US 8,714,612 B2
(45) Date of Patent: May 6, 2014

(54) MULTI-PURPOSE ROLL-IN EMERGENCY COT

(75) Inventor: Robert Chinn, Cumming, GA (US)

(73) Assignee: Ferno-Washington, Inc., Wilmington, OH (US)

( * ) Notice: Subject to any disclaimer, the term of this patent is extended or adjusted under 35 U.S.C. 154(b) by 220 days.

(21) Appl. No.: 13/124,552

(22) PCT Filed: Oct. 19, 2009

(86) PCT No.: PCT/US2009/005667

§ 371 (c)(1),
(2), (4) Date: Jul. 11, 2011

(87) PCT Pub. No.: WO2010/044890

PCT Pub. Date: Apr. 22, 2010

(65) Prior Publication Data

US 2011/0260483 A1 Oct. 27, 2011

Related U.S. Application Data

(60) Provisional application No. 61/106,567, filed on Oct. 18, 2008.

(51) Int. Cl.
*B61G 1/02* (2006.01)

(52) U.S. Cl.
USPC ..... 296/20

(58) Field of Classification Search
USPC ..... 296/20; 5/110, 11, 111, 114, 611, 620, 5/625, 626, 627, 86.1, 112, 113, 99.1
See application file for complete search history.

(56) References Cited

U.S. PATENT DOCUMENTS 2,319,008 A * 5/1943 McCormack ..... 280/5.22
3,088,770 A * 5/1963 Ferneau et al. ..... 296/20

(Continued)

FOREIGN PATENT DOCUMENTS

CA 2 438 906 A1 8/2003
DE 199 15 431 A1 10/2000

(Continued)

OTHER PUBLICATIONS

International Search Report for PCT/US2009/005667 dated Apr. 2, 2010.

*Primary Examiner* — Kiran B Patel
(74) *Attorney, Agent, or Firm* — Dinsmore & Shohl LLP

(57) ABSTRACT

A roll-in cot for patient transport and method thereof are disclosed. The cot provides a patient transporter having a support frame configured to support a stretcher on a top side of the support frame and having a sliding track mounted to an under-side of the support frame. A pair of collapsible leading legs is pivotally mounted on the underside of the support frame, and a pair of collapsible and retractable trailing legs is pivotally mounted to the underside of the support frame and also moveably coupled to the sliding track. The trailing legs are configured to swivel from a raised position to a collapsed, unretracted position wherein the pair of trailing legs extend a first horizontal distance past a trailing end of the support frame. The pair of trailing legs are further configured to slide inwardly from a collapsed, unretracted position to a collapsed, retracted position wherein the pair of collapsible and trailing legs extends a second horizontal distance past a trailing end of the support frame, wherein the second horizontal distance is less than the first horizontal distance.

4 Claims, 21 Drawing Sheets

(56) References Cited

U.S. PATENT DOCUMENTS

| | | | | |
|---|---|---|---|---|
| 3,332,661 | A | 7/1967 | Hand | |
| 3,759,565 | A * | 9/1973 | Ferneau | 296/20 |
| 3,826,528 | A * | 7/1974 | East | 296/20 |
| 3,980,334 | A * | 9/1976 | Ferneau et al. | 296/20 |
| 4,023,849 | A * | 5/1977 | Bethlen | 296/20 |
| 4,037,871 | A * | 7/1977 | Bourgraf et al. | 296/20 |
| 4,052,097 | A * | 10/1977 | Weil et al. | 296/20 |
| 4,192,541 | A * | 3/1980 | Ferneau | 296/20 |
| 4,682,810 | A * | 7/1987 | Zarka | 296/20 |
| 4,783,109 | A * | 11/1988 | Bucalo | 296/20 |
| 4,921,295 | A * | 5/1990 | Stollenwerk | 296/20 |
| 5,015,024 | A * | 5/1991 | Bloemer | 296/20 |
| 5,432,966 | A * | 7/1995 | Berta et al. | 5/611 |
| 5,481,770 | A * | 1/1996 | Ahlsten | 5/625 |
| 5,509,159 | A * | 4/1996 | Du-Bois | 5/627 |
| 5,535,964 | A * | 7/1996 | Ahlsten | 244/118.5 |
| 6,045,150 | A * | 4/2000 | Al-Toukhi | 280/641 |
| 6,203,085 | B1 | 3/2001 | Ferris | |
| 6,332,638 | B1 * | 12/2001 | Menna | 296/20 |
| 6,654,973 | B2 * | 12/2003 | Van Den Heuvel et al. | 5/611 |
| 6,735,794 | B1 * | 5/2004 | Way et al. | 5/86.1 |
| 6,976,696 | B2 * | 12/2005 | O'Krangley et al. | 280/640 |
| 7,003,829 | B2 * | 2/2006 | Choi et al. | 5/611 |
| 7,424,758 | B2 * | 9/2008 | Broadley et al. | 5/625 |
| 7,490,884 | B2 * | 2/2009 | Matunaga et al. | 296/20 |
| 7,621,003 | B2 * | 11/2009 | Myers et al. | 5/86.1 |
| 7,631,373 | B2 * | 12/2009 | Broadley et al. | 5/86.1 |
| 7,637,550 | B2 * | 12/2009 | Menna | 296/20 |
| 7,775,574 | B2 * | 8/2010 | Matunaga et al. | 296/20 |
| 7,856,685 | B2 * | 12/2010 | Matunaga et al. | 5/611 |
| 8,444,195 | B2 * | 5/2013 | Bourgraf et al. | 296/20 |
| 2004/0111798 | A1 * | 6/2004 | Matunaga et al. | 5/86.1 |
| 2006/0016008 | A1 | 1/2006 | Choi et al. | |
| 2006/0225203 | A1 * | 10/2006 | Hosoya et al. | 5/86.1 |
| 2011/0018296 | A1 * | 1/2011 | Broadley et al. | 296/20 |
| 2011/0266821 | A1 * | 11/2011 | Goto et al. | 296/20 |
| 2012/0275896 | A1 * | 11/2012 | Magill et al. | 414/800 |

FOREIGN PATENT DOCUMENTS

| | | | |
|---|---|---|---|
| DE | 202006006041 | U1 | 7/2006 |
| EP | 1026063 | A1 | 8/2000 |
| EP | 1245212 | A1 | 10/2002 |
| FR | 2895671 | A1 | 7/2007 |
| GB | 2 298 619 | A | 9/1996 |
| NL | 8901747 | A | 2/1991 |
| WO | 02/34191 | A1 | 5/2002 |
| WO | 01/70161 | A1 | 9/2002 |
| WO | 2007/028883 | A3 | 3/2007 |

* cited by examiner

MULTI-PURPOSE ROLL-IN EMERGENCY COT

The present invention is generally related to emergency cots, and is specifically directed to roll-in emergency cots that provide better management of the cot weight and provides for loading at higher cot heights by optimizing the positioning of the trailing cot legs, wherein the trailing cot legs are retractable and collapsible telescoping cot legs.

There is a variety of emergency cots in use today. One variety is a multipurpose roll-in emergency cot having a patient support stretcher that is removably attached to a wheeled undercarriage or transporter. The patient support stretcher when removed for separate use from the transporter may be shuttled around horizontally upon an included set of wheels. One recognized advantage of such a cot design is that the stretcher may be separately rolled into an emergency vehicle that is a patient transport vehicle 600 such as station wagons, vans, modular ambulances, aircrafts, or helicopters, where space and reducing weight is a premium.

Another advantage of such a cot design is that the separated stretcher may be more easily carried over uneven terrain and out of locations where it is impractical to use a complete cot to transfer a patient. Example of such prior art cots can be found in U.S. Pat. Nos. 4,037,871, 4,921,295, and International Publication No. WO0170161A1.

Although the foregoing prior art multipurpose roll-in emergency cots have been generally adequate for their intended purposes, they have not been satisfactory in all aspects.

The present invention addresses a need that has arisen for a more versatile multipurpose roll-in emergency cot which provides better management of the cot weight and provides for loading at higher cot heights, while being rollable into various types of rescue vehicles, such as ambulances, vans, station wagons, aircrafts and helicopters.

In accordance with one embodiment of the present invention, a roll-in cot for patient transport is provided. The roll-in cot comprises a patient transporter, wherein the patient transporter comprises a support frame configured to support a stretcher on a top side of the support frame. The roll-in cot also comprises a sliding track mounted to an underside of the support frame, a pair of collapsible leading legs pivotally mounted on the underside the support frame, and a pair of collapsible and retractable trailing legs pivotally mounted to the underside of the support frame and also moveably coupled to the sliding track. The trailing legs are configured to swivel from a raised position to a collapsed, unretracted position wherein the pair of trailing legs extend a first horizontal distance past a trailing end of the support frame. The pair of trailing legs are further configured to slide inwardly from a collapsed, unretracted position to a collapsed, retracted position. In the collapsed, retracted position, the pair of collapsible and trailing legs extend a second horizontal distance past a trailing end of the support frame, wherein the second horizontal distance is less than the first horizontal distance.

These and additional features provided by the embodiments of the present invention will be more fully understood in view of the following detailed description, in conjunction with the drawings.

The following detailed description of specific embodiments of the present invention can be best understood when read in conjunction with the following drawings, where like structure is indicated with like reference numerals and in which.

Figure 1:
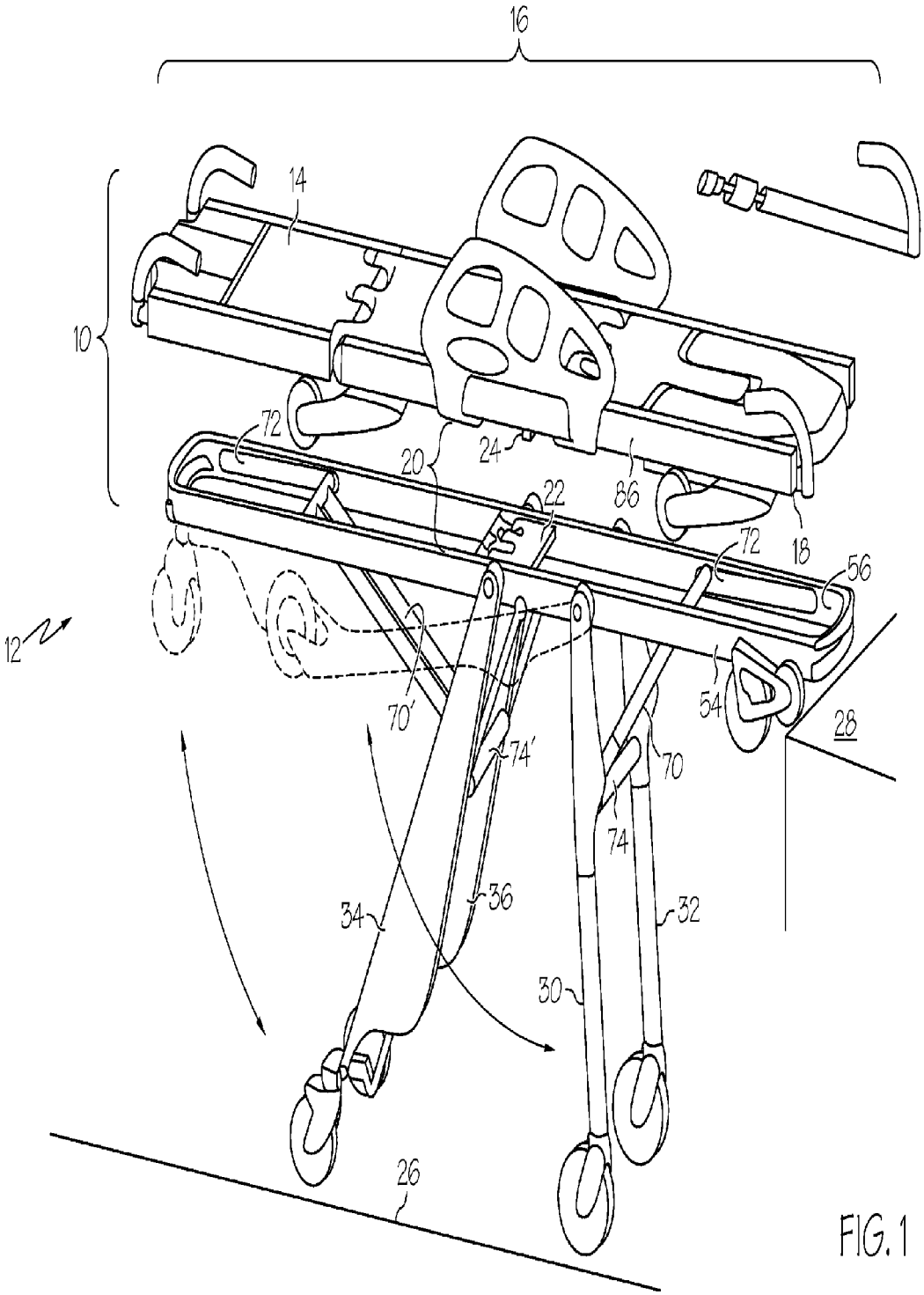
FIG. 1 is a perspective view of a stretcher showing its relationship to an underlying supporting transporter which together form a multipurpose roll-in emergency cot according to the present invention.

The embodiments set forth in the drawings are illustrative in nature and not intended to be limiting of the invention defined by the claims. Moreover, individual features of the drawings and invention will be more fully apparent and understood in view of the detailed description.

Embodiments of the present invention are generally directed to roll-in cots comprising optimally positioned trailing cot legs for weight balancing. In further embodiments, the trailing cot legs are retractable and collapsible, telescoping cot legs. The telescoping legs enable the cot to be raised to load heights which are higher than possible with existing independent leg cots. Additionally, embodiments of the present invention are directed to trailing legs which can be located closer to the rear of the cot than existing cots, thereby enabling the trailing legs to support the weight of the cot during loading of a patient onto a patient transport vehicle. The trailing legs support the weight of the cot up to the point where the center of gravity of the cot is shifted sufficiently forward, so that the entire weight of the cot is born by the vehicle. At that point, the trailing legs can be collapsed and retracted.

Figure 2:
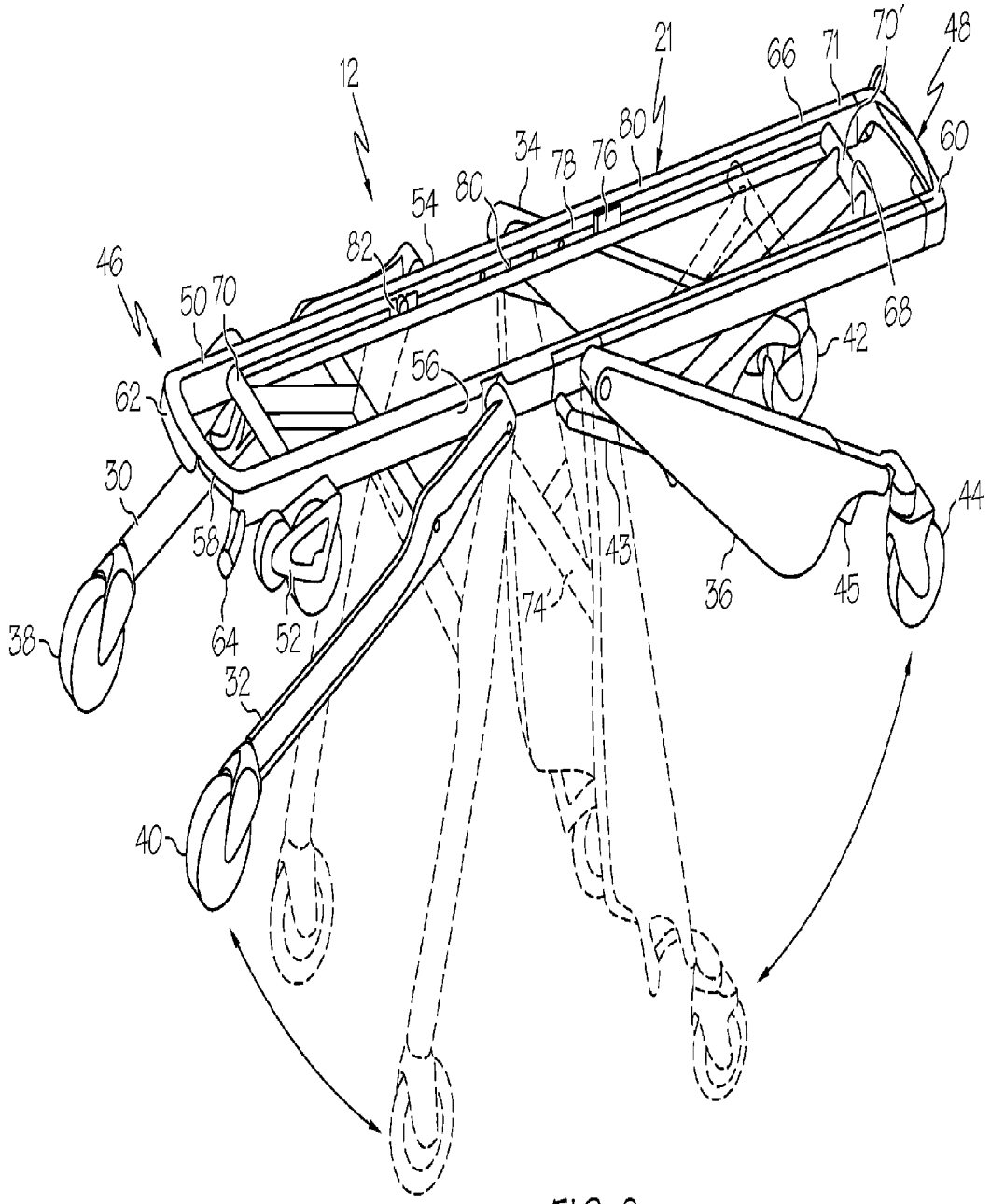
FIG. 2 is a perspective view of a transporter, with parts eliminated for clarity to show the features according to the present invention.

Before turning to the specific embodiments of the roll-in cot, FIGS. 1 and 2 and the description herewith is provided to illustrate the components of a roll-ion cot. FIG. 1 illustrates a multipurpose roll-in emergency cot 10 of the present invention, comprising a transporter, indicated generally at 12, which underlies and supports a detachable stretcher, indicated generally at 14. The stretcher 14, which in use supports a patient thereon, may be in one embodiment a patient air transport litter and in another embodiment is a wheeled stretcher that is positionable in recumbent/supine, shock, contoured, and chair positions. When separated from the transporter 12, in one embodiment the stretcher 14 is adapted to roll upon provided wheels (not shown) and in another embodiment on end when provided in the chair position.

In one embodiment, the emergency cot 10 is provided with a locking mechanism 20 to detachably secure the stretcher 14 to the transporter 12. The locking mechanism 20 includes a female fastening member 22 connected to a support frame 21 of the transporter 12, the female fastening member 22 having a locked position and a release position. The female fastening member 22 is normally biased in the locked position, wherein an actuator (not shown) is used for moving the female fastening member 22 from the locked position to the release position. Since the internal locking components of the female fastening member 22 are conventional, for the purpose of brevity no discussion is provided about the internal components of the female fastening member 22. The female-fastening member 22 cooperates with at least one male fastening member 24 provided on the stretcher frame 18, such that the male fastening member 24 is engaged by the female fastening member 22 in the locked position. The fastening members 22 and 24 of the locking mechanism 20 are located at approximately the midsections of their respective frames 21 and 18, such that the stretcher 14 may be releasably fastened in either loading direction to the transporter 12.

The transporter 12 is used to elevate the stretcher 14 when attached above a surface 26. Either the transporter 12 or stretcher 14 may be secured to a surface or floor 28 of a transport vehicle via a similar male/female-fastening arrangement, if so desired. In such an arrangement, additional securing attachments and/or fastening devices are not required to be carried or provided should there be a need to secure either the transporter 12 or stretcher 14 to the transport vehicle floor 28.

Viewing the embodiment of FIG. 2, the transporter 12 comprises a pair of collapsible leading legs 30 and 32, and a pair of collapsible trailing legs 34 and 36 both pivotally mounted to the support frame 21. The leading legs 30 and 32 mount at ends thereof a pair of fixed wheels 38 and 40. The trailing legs 34 and 36 mount at ends thereof a pair of locking swivel casters 42 and 44. The support frame 21 of the transporter 12 is generally rectangular and defines on its shorter sides a loading end 46 and a trailing end 48. Provided at the loading end 46 of the support frame 21 is a pair of drop-frame loading wheels 50 and 52 to facilitate easier loading of the cot 10 onto the floor 28 (FIG. 1) of the transport vehicle.

Such loading wheels are described in commonly assigned U.S. Pat. No. 6,203,085, filed Jul. 14, 1999 for DEVICE FOR FACILITATING THE LOADING OF STRETCHER UNDERCARRIAGES INTO AMBULANCES, in which the entire description is herein incorporated by reference.

The support frame 21 may further comprise opposed, elongated side frame members 54 and 56 that are integrally connected at the loading and trailing ends 46 and 48, respectively, by first and second end portions 58 and 60, respectively. Each of the end portions 58 and 60 provides rotatably connected handgrip portions 62 and 64, wherein each handgrip has an extended position extending outwardly from the support frame 21 and a folded position adjacent the support frame 21 as illustrated. The opposed side frame members 54 and 56 provide longitudinally extending guide rail surfaces 66 and 68 that are shaped to conveniently support the stretcher 14 thereon.

As illustrated by the broken lines in FIGS. 1 and 2, which indicate the range of motion of the legs 30,32,34 and 36, the transporter 12 may be positioned in a fully collapsed position for loading onto the surface 28 of the transport vehicle (FIG. 1), and one of a number of elevated positions between a raised and lowered position to adjust the relative height of the support frame above the surface 26 (FIG. 2). In the fully collapsed position the legs 30,32,34, and 36 are positioned adjacent the support frame 21 providing the transporter 12 in its lowest compact position. Additionally, while provided in the collapsed position, the swivel casters 38 and 40 may be provided with a self-locking feature which prevents swiveling if desired. Furthermore, as best shown in FIG. 2, self leveling of each swivel casters 42 and 44 is provide for by an actuator arm (same on side not shown) being pivotably connected to the support frame 21 at one end and a leveling mechanism 45 of the respective swivel caster 42 or 44, such that the leveling mechanism 45 will keep wheels 42 and 44 in an orientation that allows them to swivel freely when the respective trailing leg is placed in the fully collapsed position or in any other position.

In the lowered position, the legs 30,32,34, and 36 of the transporter 12 are outwardly extended underneath the support frame 21. In the raised position, the legs 30, 32,34, and 36 are approximately perpendicular to the support frame 21, providing the loading end 46 of support frame 21 at its highest height relative to the supporting surface 16 of the transporter 12 such that the cot 10 may be loaded without lifting into a transporter vehicle having the floor 28 up to approximately 86.4 centimeters (34 inches) above the supporting surface 26.

To provide for a number of positions between the lowered and raised positions, each leg pair 30,32 and 34,36 are pivotably mounted to a respective brace member 70 and 70'. Each brace member 70 and 70' has a first end thereof pivotally and slidably mounted to a respective pair of inwardly facing slots 72 (same on the side not shown) provided in the opposed side frame members 54 and 56 (FIG. 1). A second end of each brace member 70 and 70' of the leg pairs 30,32 and 34,36 is pivotally mounted to a respective cross member 74,74' and is adapted to provide support to the legs 30,32,34, and 36 in the elevated positions. It is to be appreciated that each cross member 74 and 74' adds strength and stability to the transporter 12.

At least one securing device 76 is provided internally to the support frame 21 to releasably arrest the vertical movement of the transporter 12, securing the support frame 21 at its height-adjusted position. As best illustrated by FIG. 2, the securing device 76 is provided internally to at least one of the side frame members 54 and 56 being tubular with hollow interiors, wherein a pair of securing bars 78 and 78' of the securing device is positioned therein. Each securing bar 78 and 78' has one or more recesses 80 spaced there along which is engaged by a respective removable and sliding latch 82 and 82' to releasably lock the transporter in one of the previously discussed positions. Each latch 82 or 82' is disengaged from the recesses 80 of its respective securing bar 78 and 78' by at least one actuator (not shown), provided at least approximate one of the end portions 58 and 60. Independent leg operation, leading leg release on one side of the trailing end for the operator to independently release the leading leg and a trailing leg release on the opposite side of the trailing end for the operator to independently release the trailing leg.

Figure 3A:
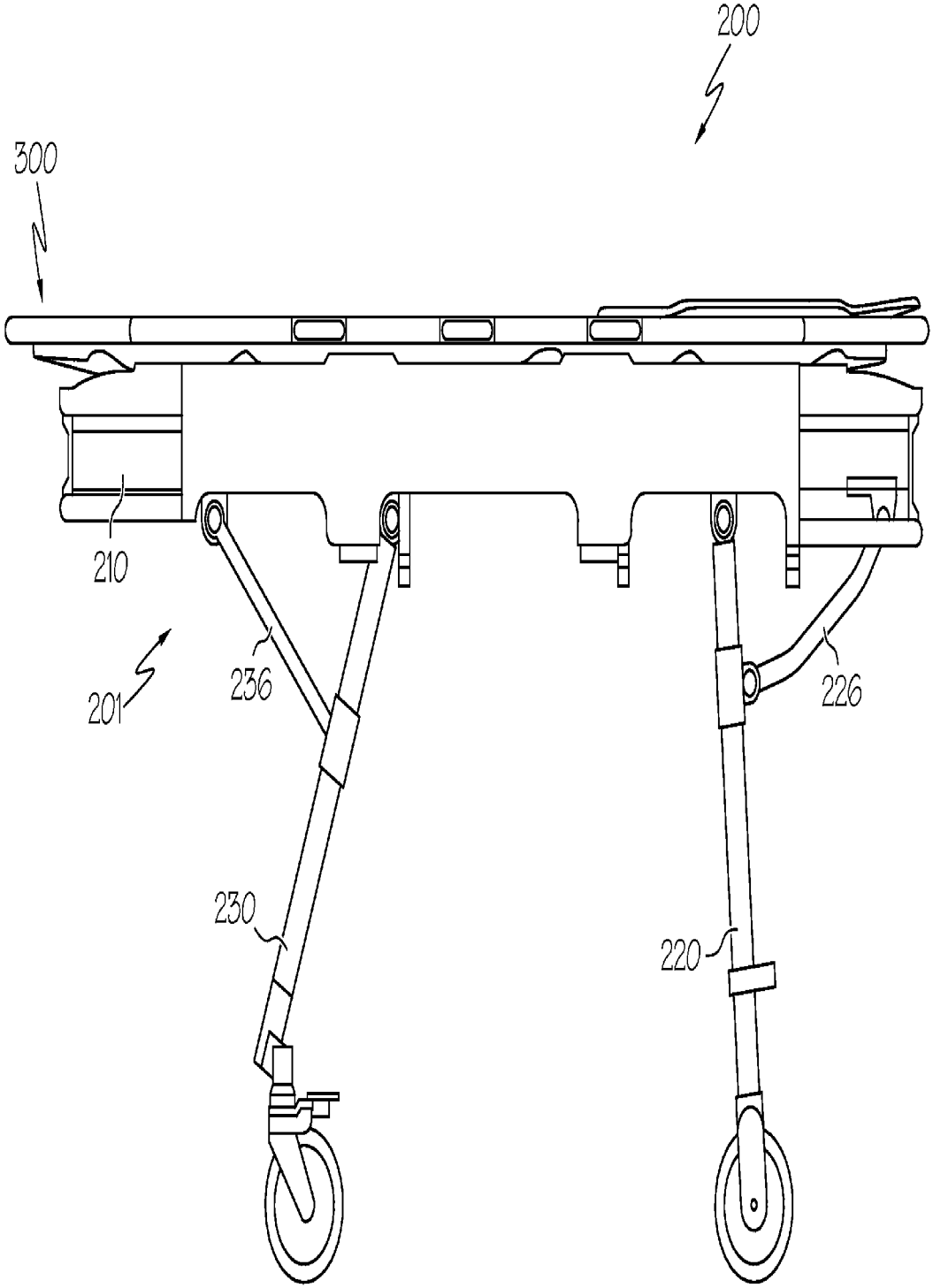
FIG. 3A is a side perspective view of a cot according to one or more embodiments of the present invention, wherein the cot is shown in a raised position.
Figure 3B:
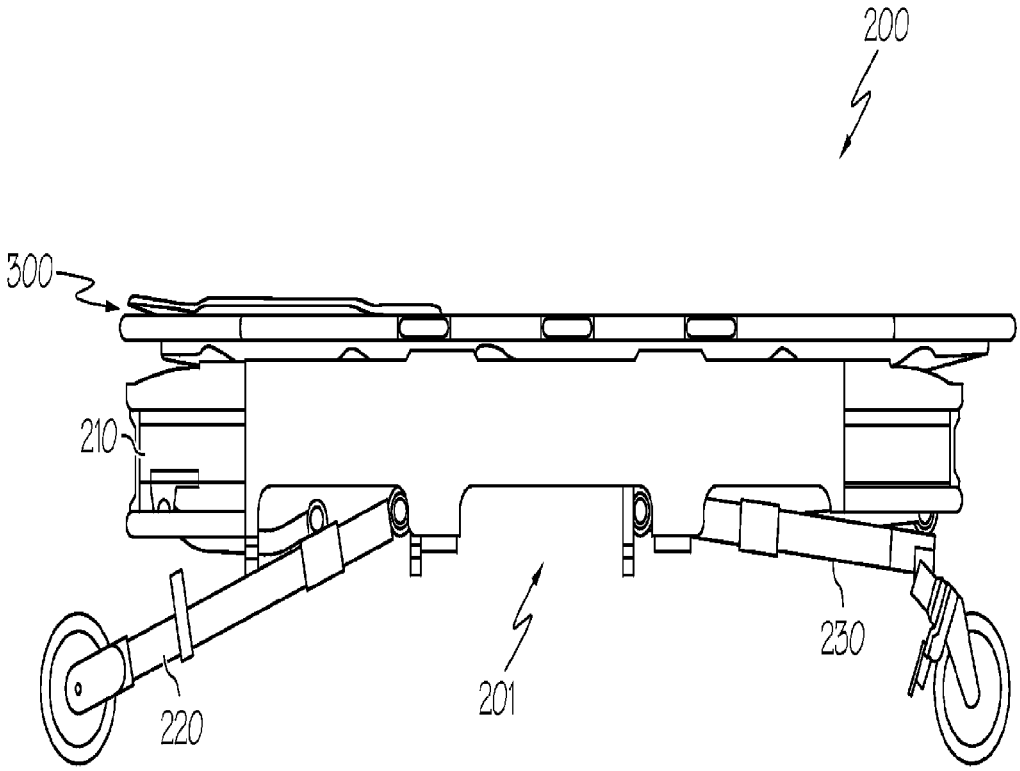
FIG. 3B is a side perspective view of the cot FIG. 3A, wherein the cot is shown in a collapsed, unretracted position.

Incorporating one or more of the components of FIGS. 1 and 2, we now refer to roll-in cot embodiments of FIGS. 3A and 3B, a roll-in cot 200 for patient transport is provided. The roll-in cot 200 comprises a patient transporter 201, which is suitable to support a stretcher 300 and a patient thereon. The roll-in cot 200 comprises a support frame 210 configured to support a stretcher 300 on a top side of the support frame 210. Various stretcher 300 embodiments suitable to transport a patient, medical equipment or both are contemplated herein. Referring again to FIGS. 3A and 3B, the roll-in cot 200 also comprises a pair of collapsible leading legs 220 pivotally mounted on the underside of the support frame 210 in a position near the leading end of the support frame 210. Similarly, the roll-in cot 200 also comprises a pair of collapsible and retractable trailing legs 230 pivotally mounted to the underside of the support frame 210 in a position near a trailing end of the support frame 210.

Figure 4A:
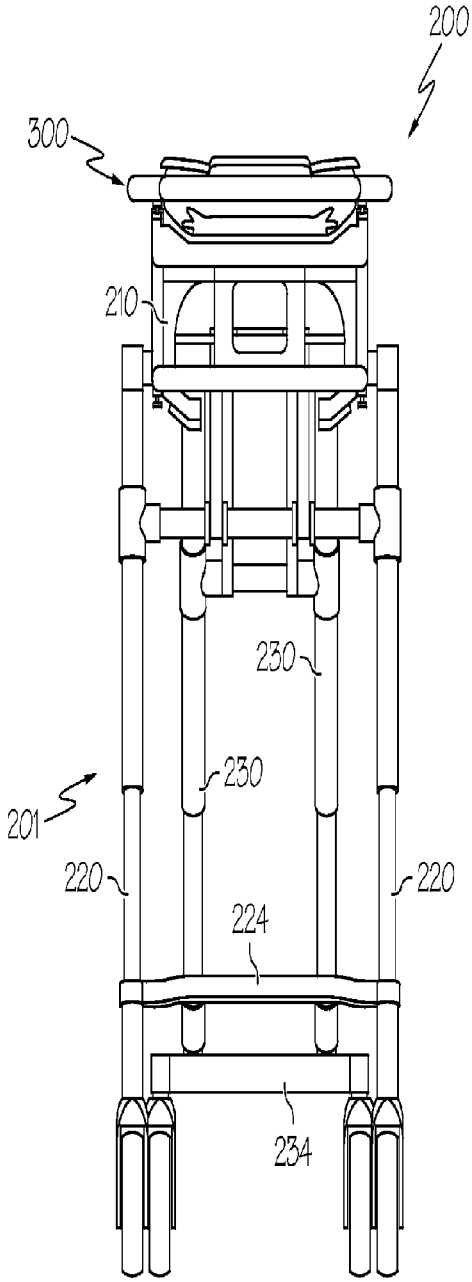
FIG. 4A is a front perspective view of a cot according to one or more embodiments of the present invention.
Figure 4B:
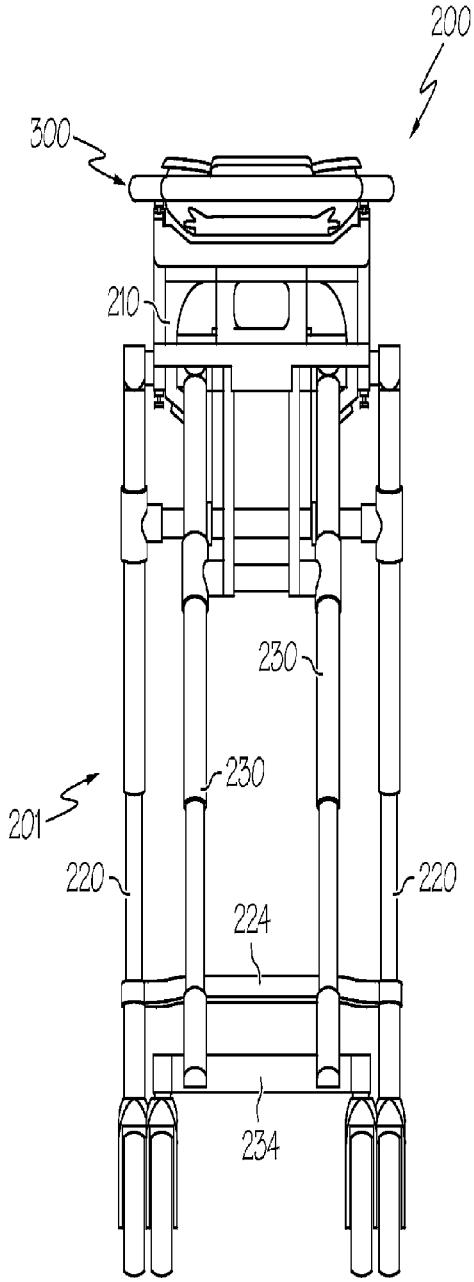
FIG. 4B is a back perspective view of the cot of FIG. 4A.

The roll-in cot 200 may positioned at a raised position as shown in FIG. 3A or a lowered position as shown in FIG. 3B. The collapsible leading legs 220 and the trailing legs 230 may comprise hinge members 226 and 236, respectively, to facilitate the movement between raised positions, lowered positions, compacted positions or various other cot positions. Additional description on the movement between raised and lowered positions are described in the paragraphs above. Referring to FIGS. 4A and 4B, the collapsible leading legs 220 and the trailing legs 230 may also comprise brace members 224 and 234, respectively, to provide additional support to the leading legs 220 and the trailing legs 230.

Figure 5:
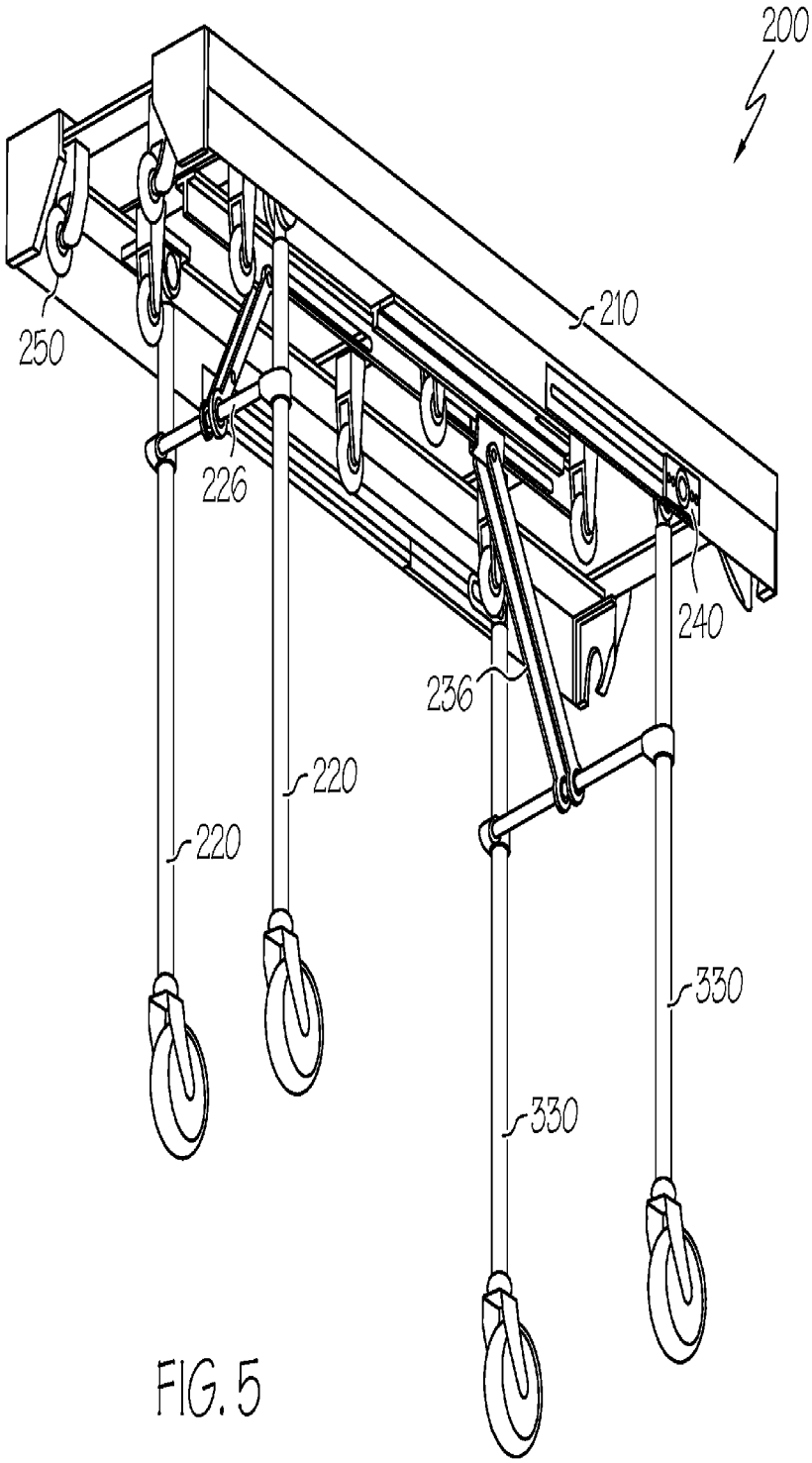
FIG. 5 is another perspective view of a cot according to one or more embodiments of the present invention.
Figure 9:
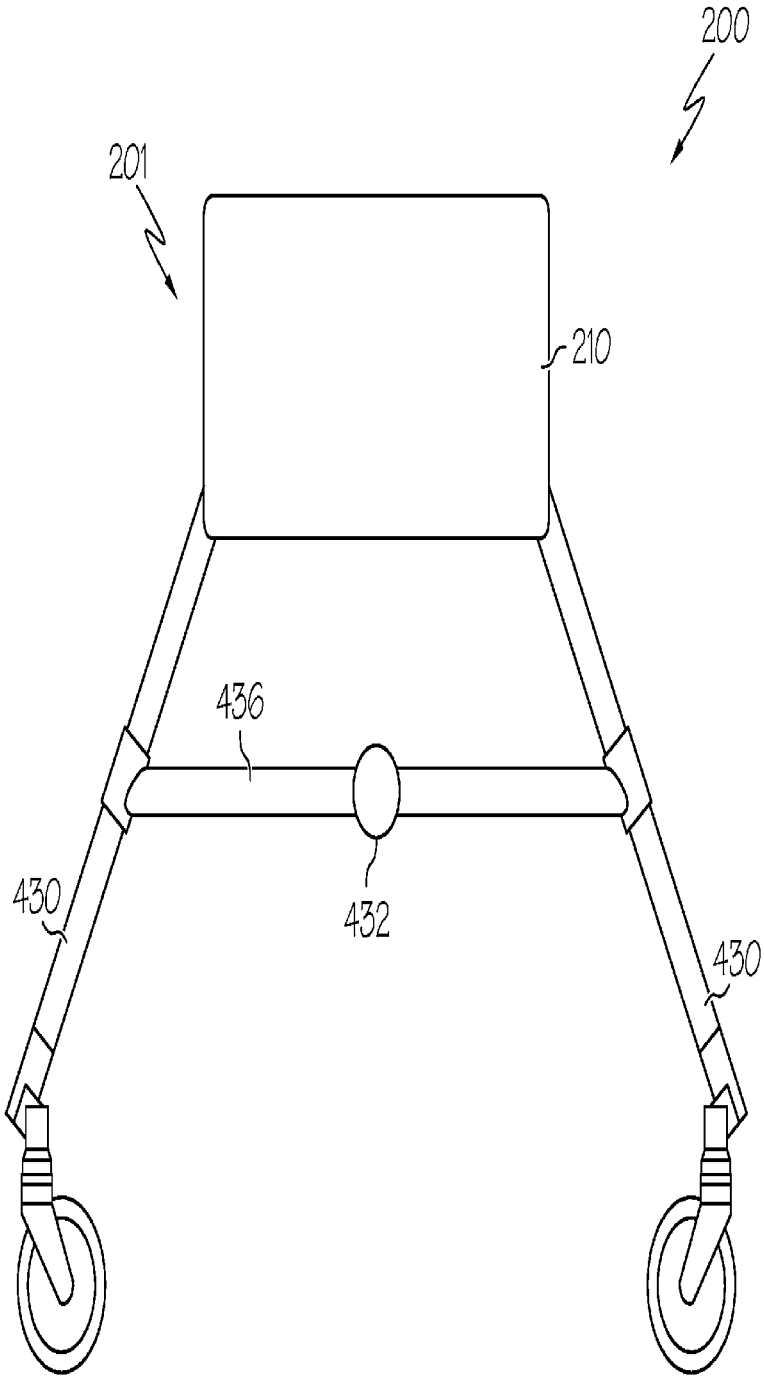
FIG. 9 is a schematic illustration of an inverted V-shaped trailing leg configuration according to one or more embodiments of the present invention.

As illustrated in the drawings, the trailing legs 330 of the FIG. 5 embodiment are substantially perpendicular relative to the support frame 210 and parallel to one another, whereas the trailing legs 230 of the FIG. 3A embodiment are slanted or non-perpendicular relative to the support frame 210 and are parallel to one another. Alternatively, referring to the embodiment of FIG. 9, the pair of trailing legs 430 extend outwardly from the support frame 210 in an inverted V-shaped configuration relative to one another when in a raised position. Further as shown in FIG. 9, the trailing legs 430 may comprise a brace member 436 between the trailing legs 430. In one embodiment the brace member 436 may be extendible and spring biased. In another embodiment, the brace member 436 may comprise a locking member 432 (for example, a screw locking mechanism) configured to stabilize the brace member 436 and the trailing legs therewith 430.

Referring to the embodiment of FIG. 5, the roll-in cot 200 may comprise a sliding track 240 mounted to an underside of the support frame. In addition to being mounted to the underside of the support frame 210, the trailing legs 330 are also moveably coupled to the sliding track. Using retractable and collapsible trailing legs 230 or 330 greatly benefits the loading process.

Figure 6A:
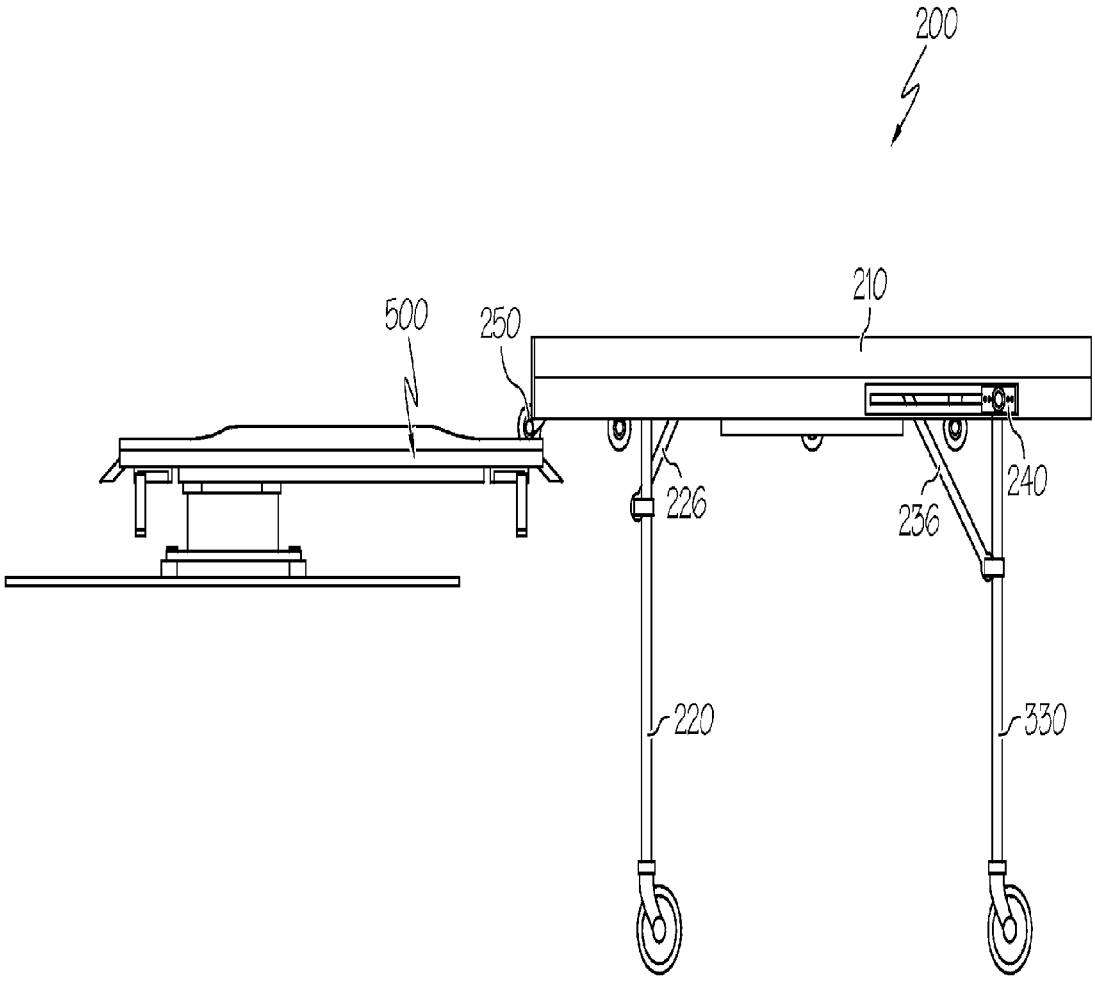
FIGS. 6A-6H are perspective views of cot of FIG. 5, showing the cot being loaded onto a mounting device of a patient transport vehicle according to one or more embodiments of the present invention.
Figure 6B:
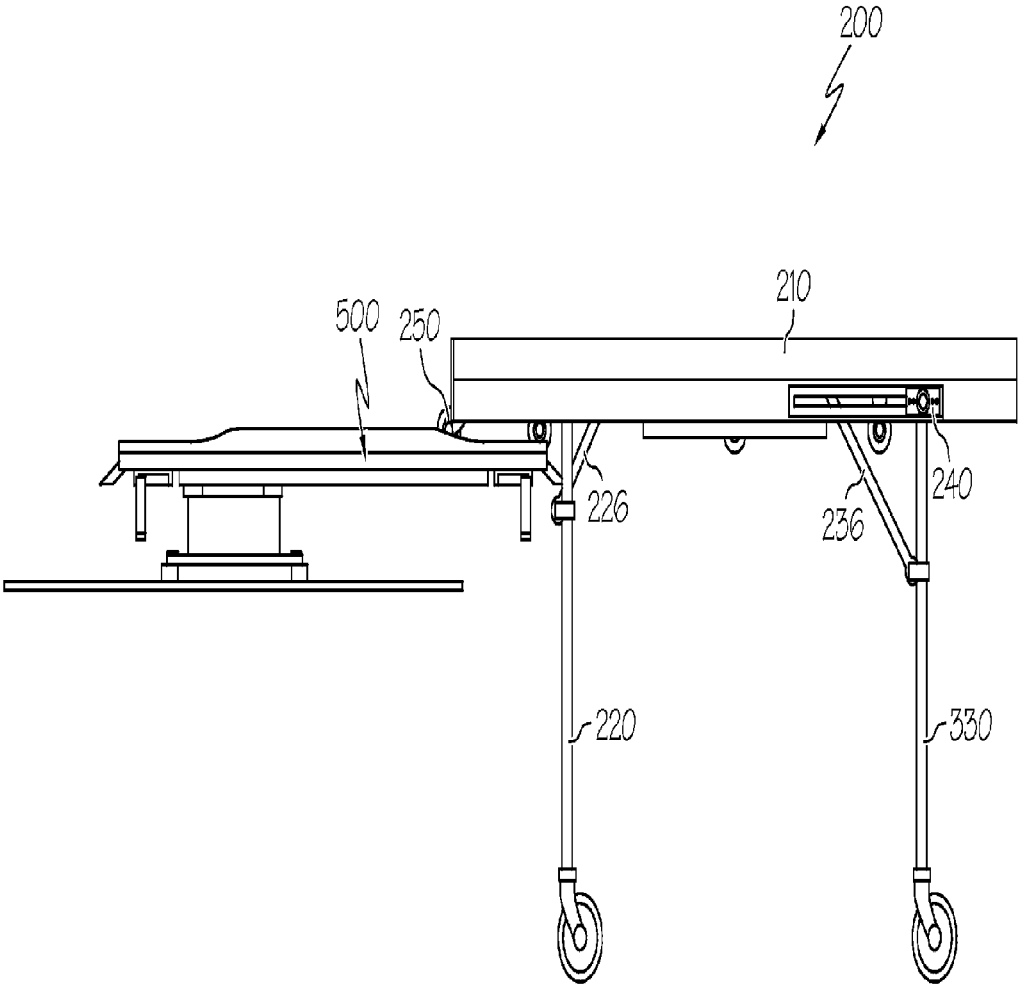
Figure 6C:
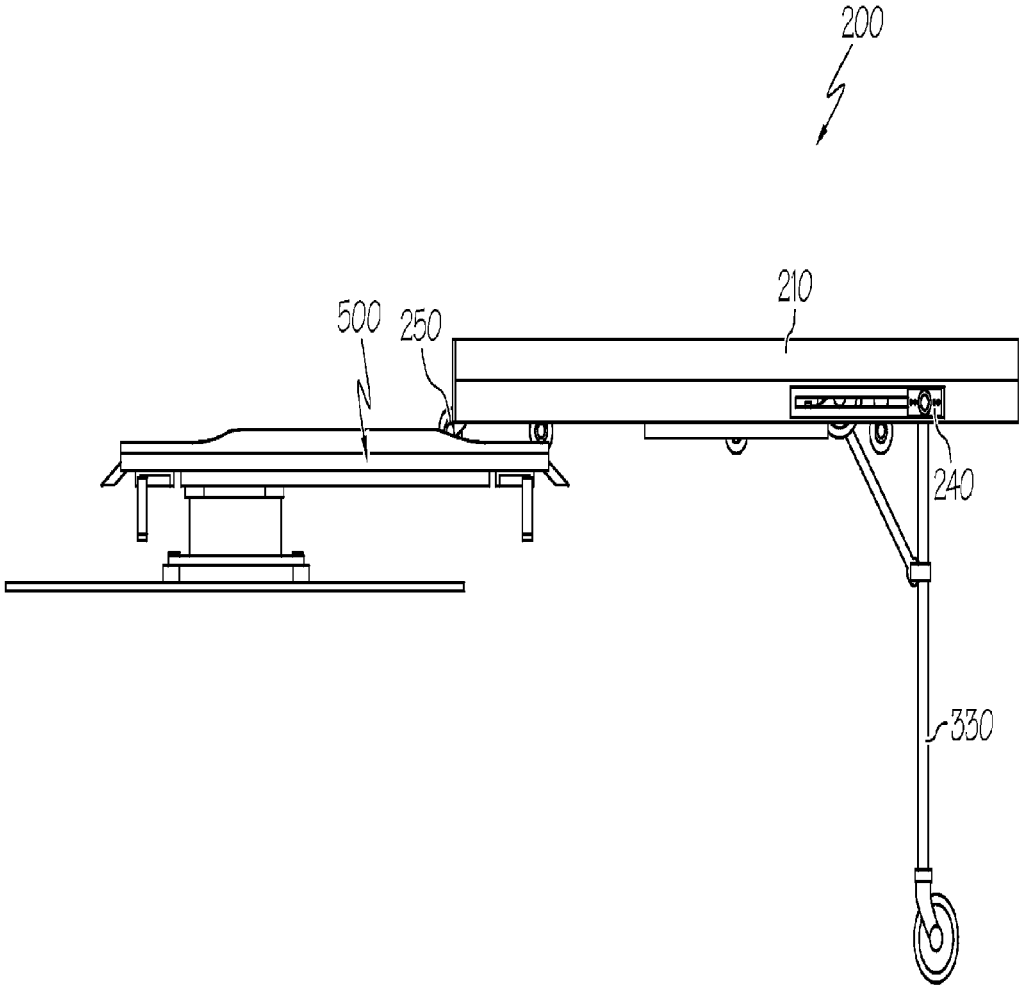
Figure 6D:
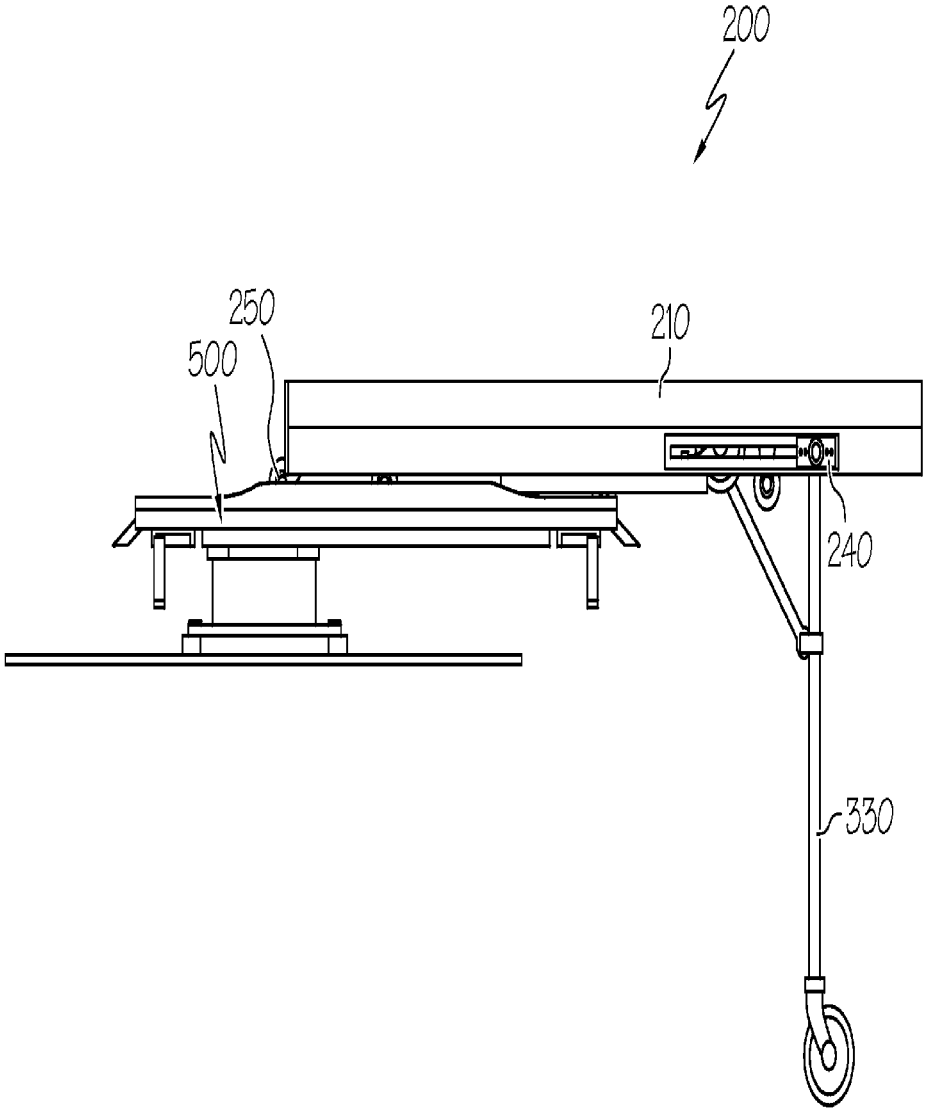
Figure 6E:
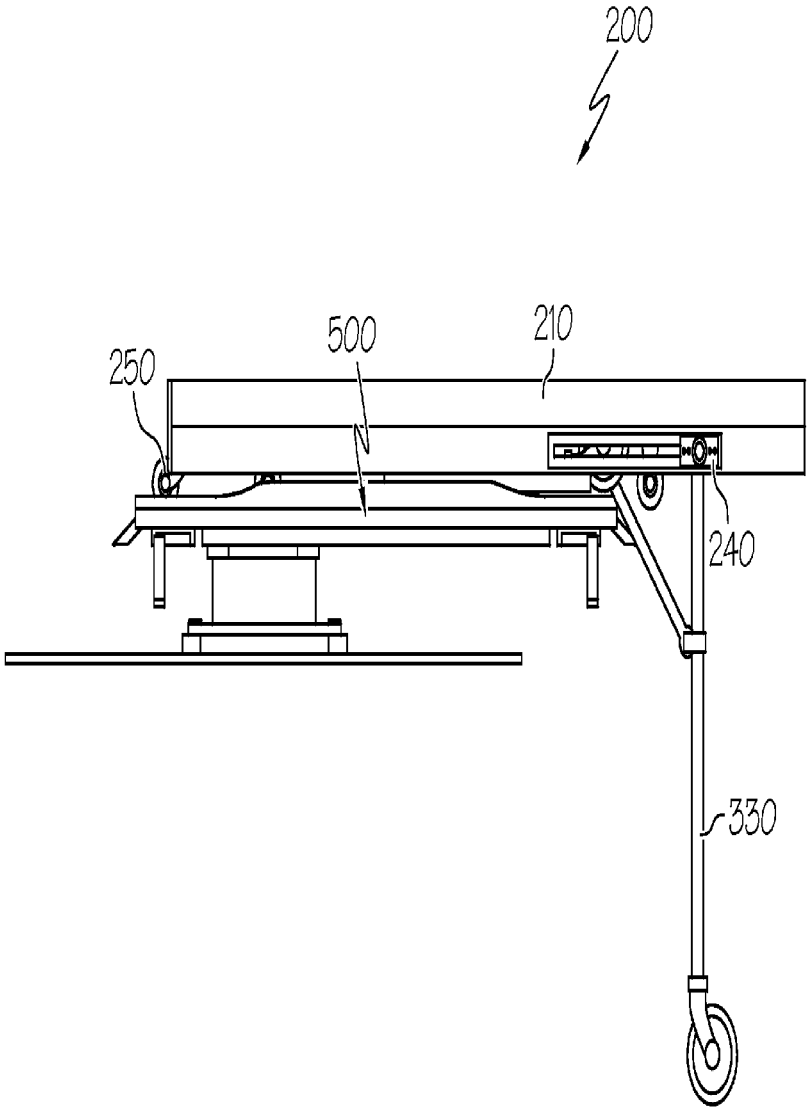

One embodiment of the loading of the cot 200 is shown in FIGS. 6A through 6H. Referring to FIG. 6A, the roll-in cot 200 is first aligned with the patient transport vehicle via the guide wheels 250. FIG. 6A shows the cot 200 being aligned with a powered cot mounting device 500 such as the Ferno Stat Trac®; however, the cot 200 may be aligned with a manual mounting device, or may simply be delivered to a flat surface. Pictures of the Stat Trac are provided in Appendix C. As the cot mounting device 500 approaches the leading legs 220 as shown in FIG. 6B, the person loading the device collapses the leading legs manually or automatically into a collapsed position as shown in FIG. 6C using components familiar to one of ordinary skill in the art. As stated above and shown, the collapsed position is more compacted than the lowered position.

Figure 6F:
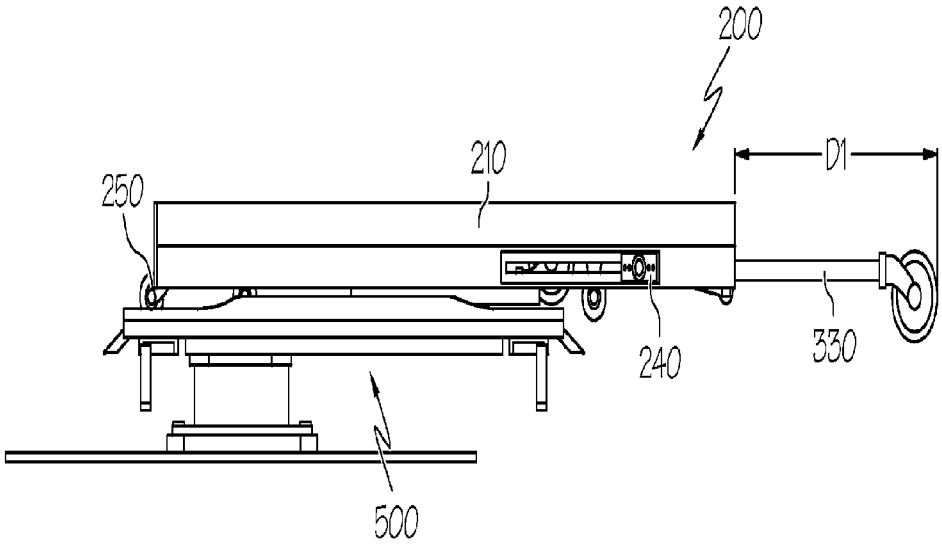
Figure 6G:
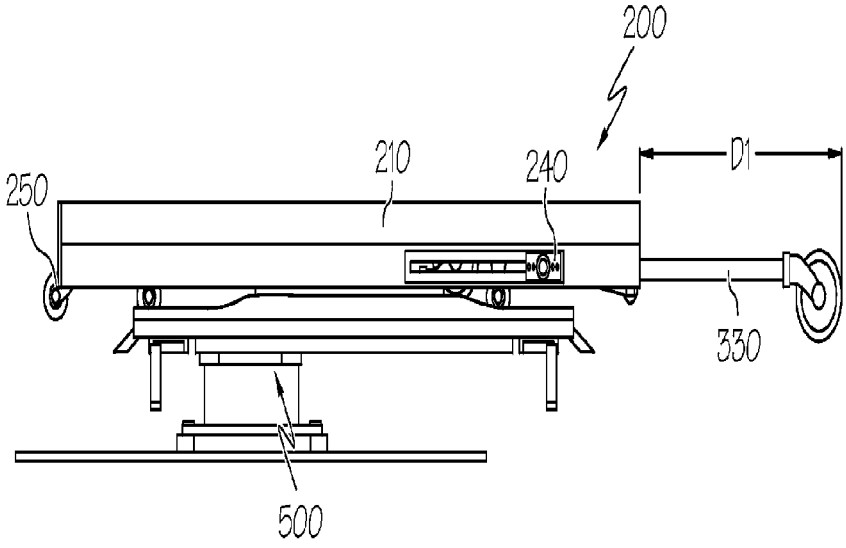

Referring to 6C and 6D, the trailing legs 330 are disposed at a rear position on the underside of the support frame 210, which enables the trailing legs 330 to support the weight of the cot 200 during loading of the cot 200 onto the mounting device 500. By positioning the trailing legs 330 in a rear position adjacent the trailing end of the support frame 210, the trailing legs are operable to bear the weight of the cot 200 until the center of gravity of the cot 200 is shifted sufficiently forward towards the loading end, such that the entire weight of the cot 200 is to be born by the vehicle and not by user loading the cot 200 onto the mounting device 500. As this point, the trailing legs 330 are configured to swivel from a raised position to a collapsed, unretracted position as shown in FIG. 6F. In the collapsed, unretracted position, the pair of trailing legs extend a first horizontal distance D1 past a trailing end of the support frame 210. As shown in FIG. 6G, the cot 200 is then moved further forward in order for the support frame 210 to be properly aligned (i.e. centered) on the mounting device 500.

Figure 6H:
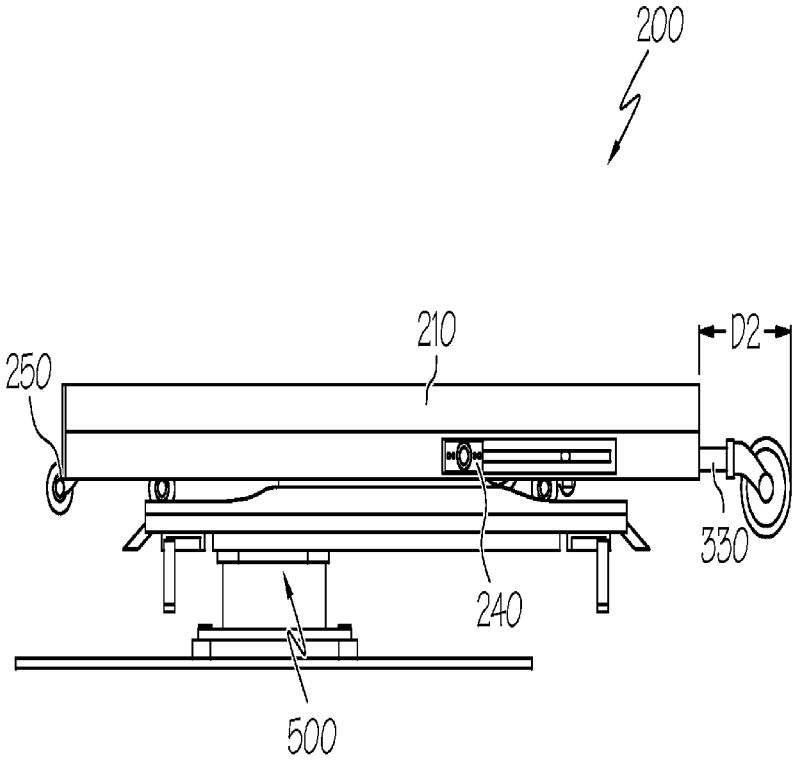
Figure 7A:
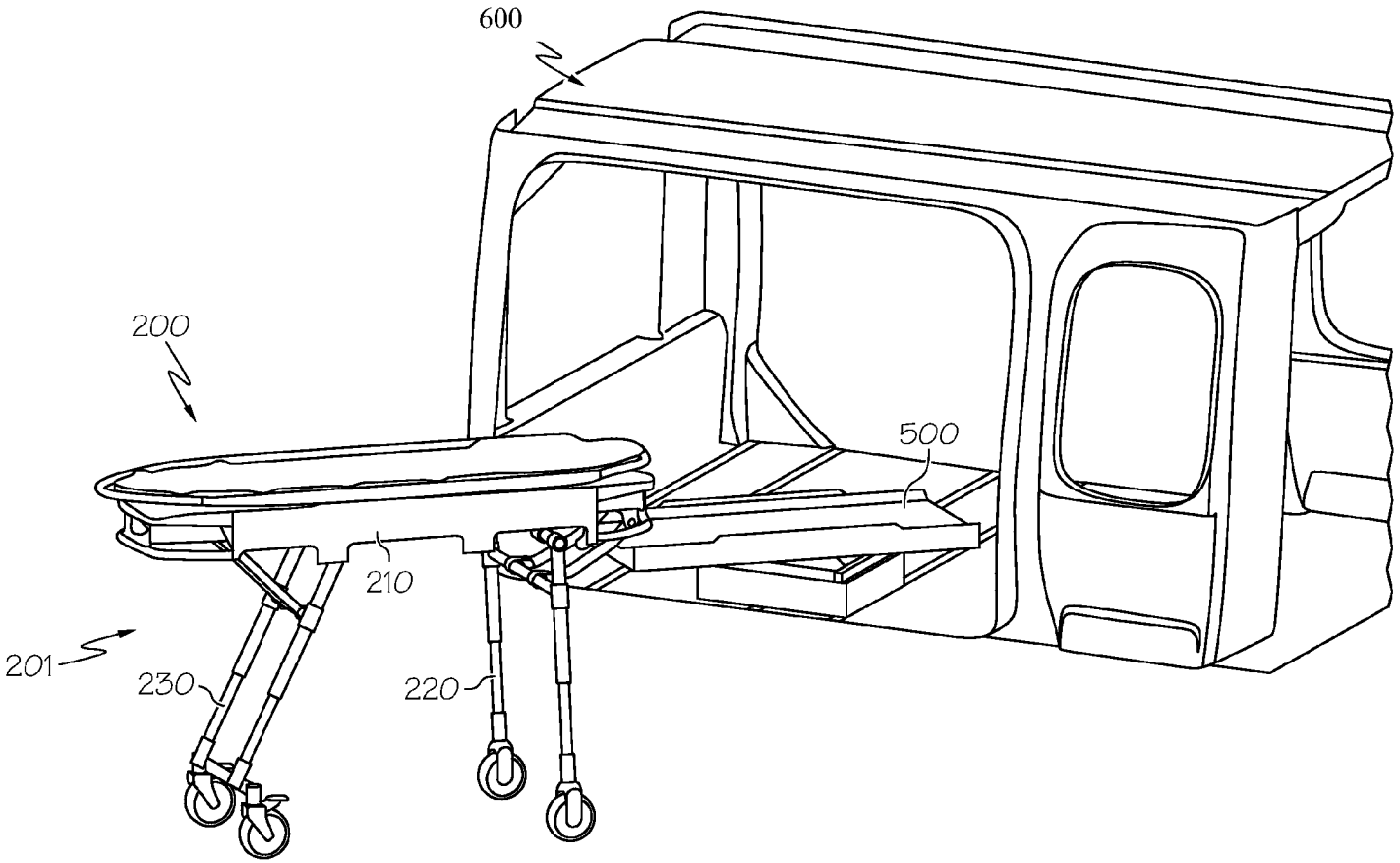
FIGS. 7A-7F are alternative perspective views showing the loading of a cot onto a mounting device of a patient transport vehicle according to one or more embodiments of the present invention.
Figure 7B:
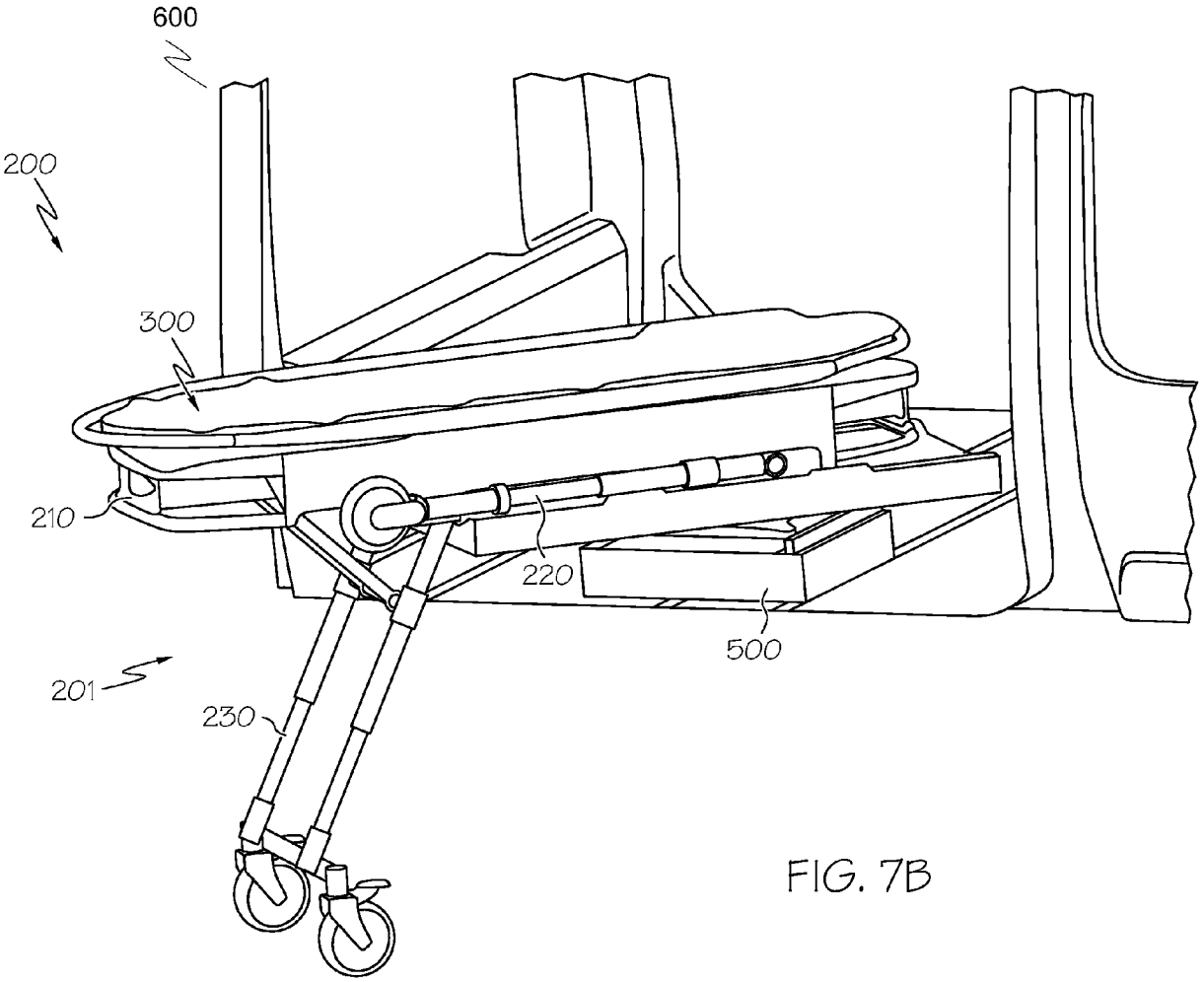
Figure 7C:
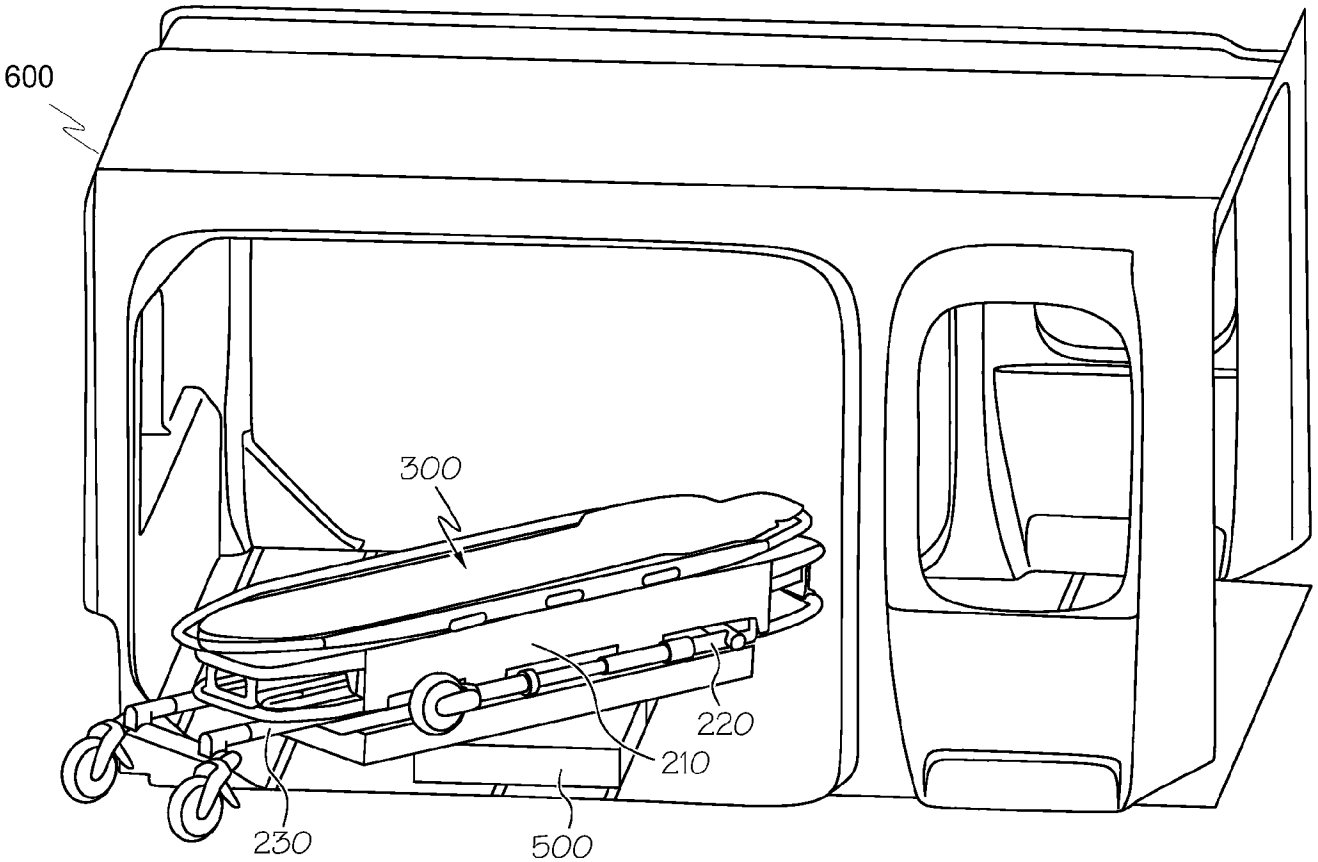
Figure 7D:
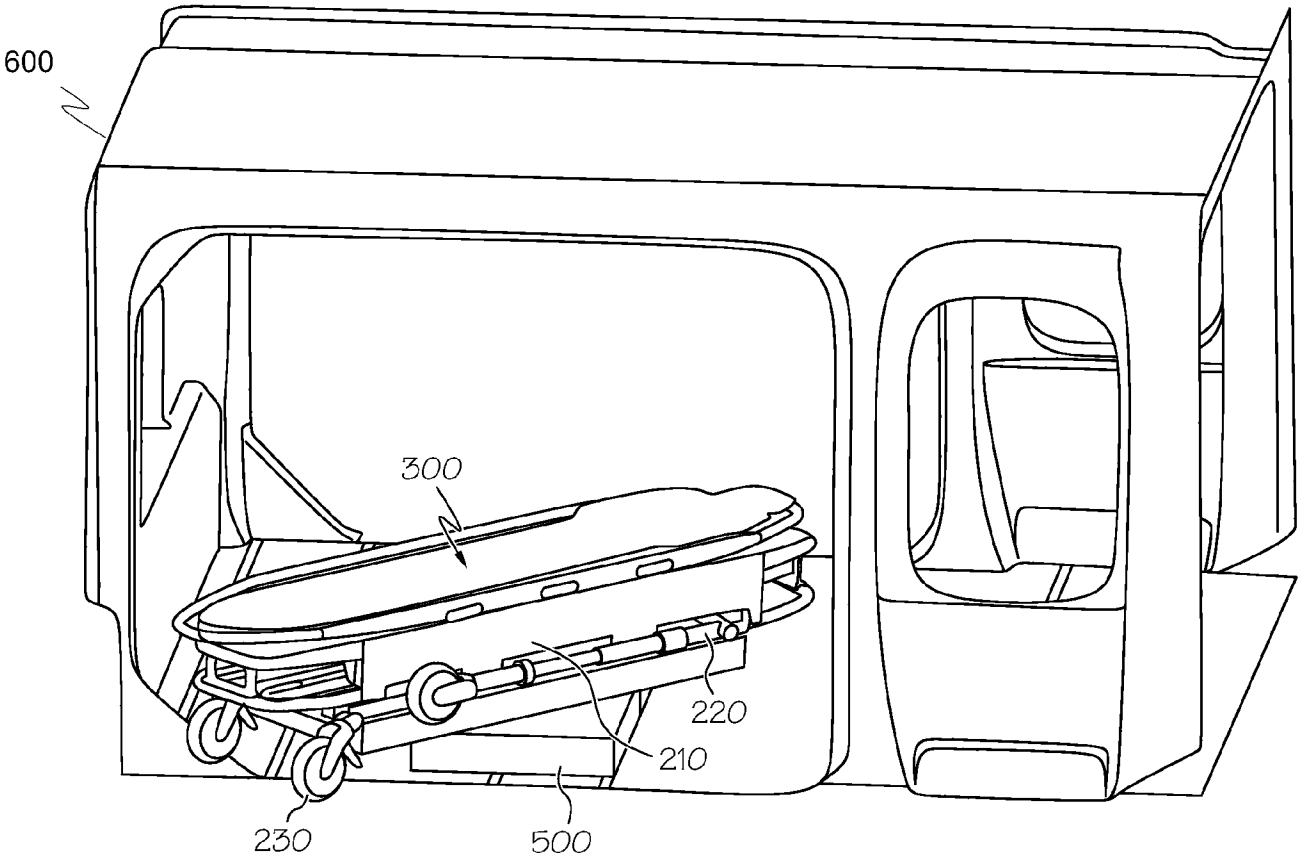
Figure 7E:
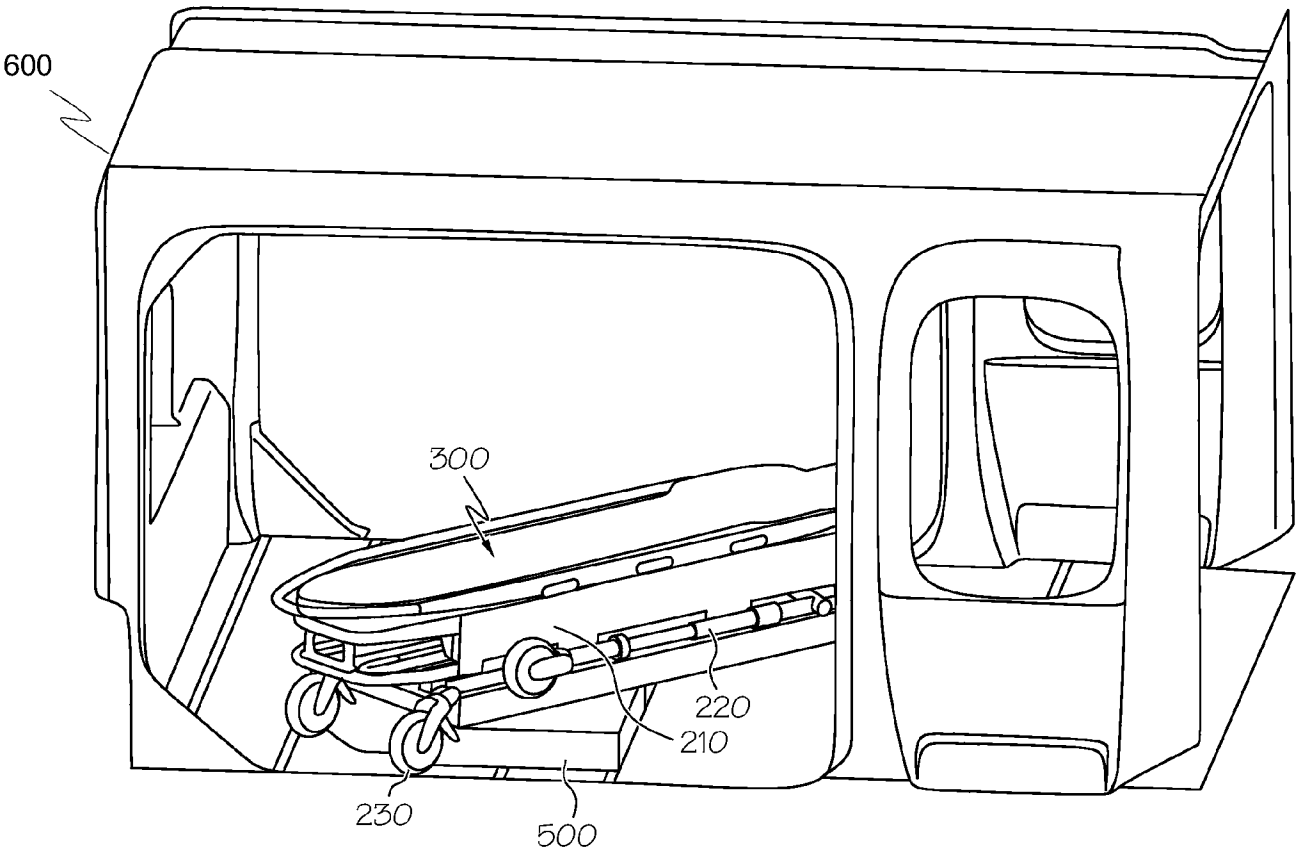
Figure 7F:
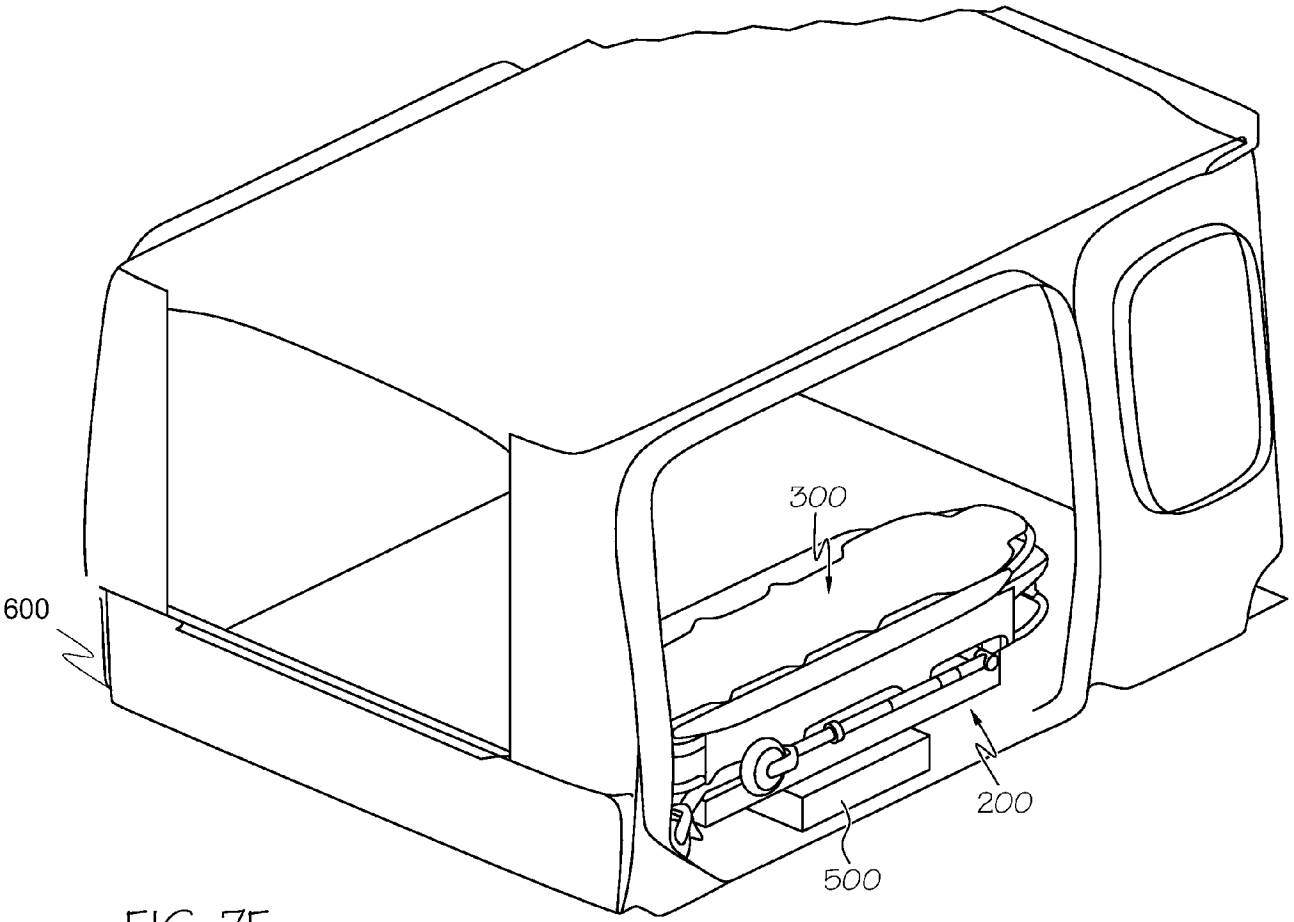

Referring to FIG. 6H, when loading a cot 200 onto a mounting device 500, it is desirable that the legs are more compacted relative to the support frame 210. Consequently, the pair of trailing legs 230 are configured to slide inwardly from a collapsed, unretracted position to a collapsed, retracted position by moving along the sliding track 240 as shown in FIG. 6H. In the collapsed, retracted position, the pair of collapsible and trailing legs 230 extends a second horizontal distance D2 past a trailing end of the support frame 210, wherein the second horizontal distance D2 is less than the first horizontal distance D1. As shown, the second horizontal distance may be less than 50% of the length of the first horizontal distance as shown in 6H. Alternatively as shown in FIG. 7D, the second horizontal distance may be substantially zero i.e., no portion of the trailing legs 230 extend past the trailing end of the support frame 210. An alternative embodiment of the loading process is provided in FIGS. 7A-7F, wherein a cot 200 is shown being loaded onto a mounting device 500 of a patient transport vehicle 600.

Figure 8A:
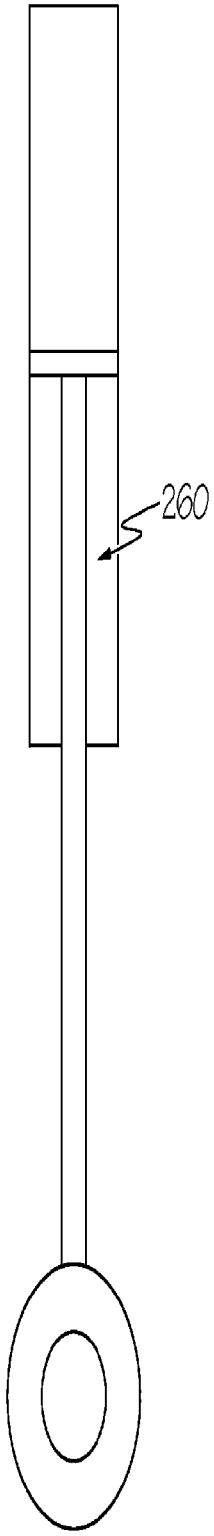
FIGS. 8A and 8B are schematic illustrations of a gas spring in a cocked and an uncocked position, respectively, according to one or more embodiments of the present invention.
Figure 8B:
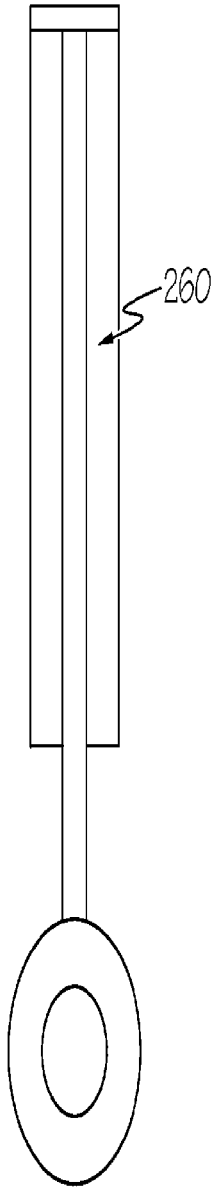

In further embodiments, the leading legs, the trailing legs, or both may comprise telescoping legs (not shown) configured to raise or lower the cot height to multiple heights. The telescoping legs may comprise a gas spring assembly 260 as shown in FIGS. 8A and 8B inside of each telescoping leg. The gas spring assembly 260 may comprise various components familiar to one of ordinary skill in the art, for example, a piston and a valve. Referring to FIG. 8A, the telescoping legs are extended when the piston is lowered or cocked, and gas pressure increases. To retract the telescoping legs, the pressure is release and the piston is raised as shown in FIG. 8B. Although gas springs are not required, they may provide lifting assistance during loading.

Numerous such modifications have already been set forth and others will undoubtedly occur to the worker in the art upon reading this specification. For example, while in the illustrated preferred embodiment the flanged rollers are mounted on the stretcher top and positioned for contact with the side rails of the underlying supporting frame, the parts can be reversed and the flanged rollers mounted on the supporting frame in positions to be contacted by the side rails of the stretcher frame. While flanged rollers are preferred, the rollers can be of a cylindrical configuration with the side rails of the supporting frame shaped to receive and guide the rollers.

It is further noted that terms like "preferably," "generally", "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

For the purposes of describing and defining the present invention it is additionally noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

The invention claimed is:

1. A roll-in cot for patient transport comprising a patient transporter, the patient transporter comprising:

a support frame configured to support a stretcher on a top side of the support frame and comprising a sliding track mounted to an underside of the support frame;

a pair of collapsible leading legs pivotally mounted on the underside of the support frame; and a pair of collapsible and retractable trailing legs pivotally mounted to the underside of the support frame and also moveably coupled to the sliding track, wherein:

the trailing legs are substantially perpendicular relative to the support frame when uncollapsed;

the trailing legs being configured to swivel from a raised position to a collapsed, unretracted position and in the collapsed, unretracted position the longitudinal axis of each trailing leg is approximately parallel with the longitudinal axis of the support frame;

the pair of trailing legs extending a first horizontal distance past a trailing end of the support frame, the pair of trailing legs being further configured to slide inwardly from a collapsed, unretracted position to a collapsed, retracted position by moving horizontally along the sliding track;

the pair of collapsible and trailing legs extending a second horizontal distance past a trailing end of the support frame, wherein the second horizontal distance is less than the first horizontal distance; and the leading legs, the trailing legs, or both comprise telescoping legs configured to raise or lower the cot height to multiple heights.

2. The roll-in cot of claim 1 wherein the second horizontal distance ranges from zero to about 50% of the length of the first horizontal distance.

3. The roll-in cot of claim 1 wherein the trailing legs are disposed at a rear position on the underside of the support frame, the rear position being configured such that the trailing legs support the weight of the cot during loading of the cot onto a patient transport vehicle up to the point where the center of gravity of the cot is shifted sufficiently forward such that the entire weight of the cot is borne by the vehicle.

4. The roll-in cot of claim 1 wherein the pair of trailing legs are arranged parallel to one another.

* * * * *

UNITED STATES PATENT AND TRADEMARK OFFICE

CERTIFICATE OF CORRECTION

PATENT NO. : 8,714,612 B2
APPLICATION NO. : 13/124552
DATED : May 6, 2014
INVENTOR(S) : Robert Chinn It is certified that error appears in the above-identified patent and that said Letters Patent is hereby corrected as shown below:

On the Title Page

Item (57) "ABSTRACT

A roll-in cot for patient transport and method thereof are disclosed. The cot provides a patient transporter having a support frame configured to support a stretcher on a top side of the support frame and having a sliding track mounted to an under-side of the support frame. A pair of collapsible leading legs is pivotally mounted on the underside of the support frame, and a pair of collapsible and retractable trailing legs is pivotally mounted to the underside of the support frame and also moveably coupled to the sliding track. The trailing legs are configured to swivel from a raised position to a collapsed, unretracted position wherein the pair of trailing legs extend a first horizontal distance past a trailing end of the support frame. The pair of trailing legs are further configured to slide inwardly from a collapsed, unretracted position to a collapsed, retracted position wherein the pair of collapsible and trailing legs extends a second horizontal distance past a trailing end of the support frame, wherein the second horizontal distance is less than the first horizontal distance."

should read

Item (57) --ABSTRACT

A roll-in cot for patient transport and method thereof are disclosed. The cot provides a patient transporter having a support frame configured to support a stretcher on a top side of the support frame and having a sliding track mounted to an underside of the support frame. A pair of collapsible leading legs is pivotally mounted on the underside of the support frame, and a pair of collapsible and retractable trailing legs is pivotally mounted to the underside of the support frame and also moveably coupled to the sliding track. The trailing legs are configured to swivel from a raised position to a collapsed, unretracted position wherein the pair of trailing legs extend a first horizontal distance past a trailing end of the support frame. The pair of trailing legs are further configured to slide inwardly from a collapsed, unretracted position to a collapsed, retracted position wherein the pair of collapsible and Signed and Sealed this
Thirty-first Day of March, 2015

Michelle K. Lee

Michelle K. Lee
*Director of the United States Patent and Trademark Office* trailing legs extends a second horizontal distance past a trailing end of the support frame, wherein the second horizontal distance is less than the first horizontal distance.--;

In the Specification

Col. 2, Line 56,
"illustrate the components of a roll-ion cot. FIG. 1 illustrates a" should read
--illustrate the components of a roll-in cot. FIG. 1 illustrates a--;

Col. 5, Line 5,
"The roll-in cot 200 may positioned at a raised position as" should read
--The roll-in cot 200 may be positioned at a raised position as--; and Col. 5, Line 65,
"loading the cot 200 onto the mounting device 500. As this" should read
--loading the cot 200 onto the mounting device 500. At this--.

UNITED STATES PATENT AND TRADEMARK OFFICE

CERTIFICATE OF CORRECTION

PATENT NO. : 8,714,612 B2
APPLICATION NO. : 13/124552
DATED : May 6, 2014
INVENTOR(S) : Robert Chinn It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 305 days.

Signed and Sealed this
Twenty-ninth Day of September, 2015

Michelle K. Lee

Michelle K. Lee
*Director of the United States Patent and Trademark Office*